US005196063A

United States Patent [19]

Ludwig

[11] Patent Number: 5,196,063

[45] Date of Patent: Mar. 23, 1993

[54] METHOD FOR APPLYING LIQUID, PASTY OR PLASTIC SUBSTANCES TO A SUBSTRATE

[76] Inventor: Volker Ludwig, Untere Muhlewiesen 10, 7986 Wutoschingen, Fed. Rep. of Germany

[21] Appl. No.: 721,115

[22] Filed: Jun. 26, 1991

[30] Foreign Application Priority Data

Jun. 27, 1990 [DE] Fed. Rep. of Germany ..... 4020420

[51] Int. Cl.[5] ..... B05C 1/08; B05C 1/14; B05C 5/02

[52] U.S. Cl. ..... 118/213; 118/249; 118/257; 118/259; 118/406; 118/410

[58] Field of Search ..... 118/61, 213, 231, 239, 118/257, 259, 249, 406, 410, 70, 231

[56] References Cited

U.S. PATENT DOCUMENTS

| | | | |
|---|---|---|---|
| 2,056,273 | 10/1936 | Holdsworth | 118/213 |
| 2,684,047 | 7/1954 | Walker | 118/257 |
| 2,904,448 | 9/1959 | Sorg | 118/213 |
| 3,818,860 | 6/1974 | Rebentisch | 118/257 |
| 4,968,534 | 11/1990 | Bugardy | 118/410 |

*Primary Examiner*—Michael G. Wityshyn
*Attorney, Agent, or Firm*—Bachman & LaPointe

[57] ABSTRACT

A method and device for applying liquid, pasty or plastic substances, in particular thermoplastics, through perforations of a cylinder, belt or the like to a substrate, in particular a textile fabric, wherein the belt or the like encloses an interior space which is evacuated, preferably continuously, during the coating operation.

18 Claims, 5 Drawing Sheets

METHOD FOR APPLYING LIQUID, PASTY OR PLASTIC SUBSTANCES TO A SUBSTRATE

Figure 1:
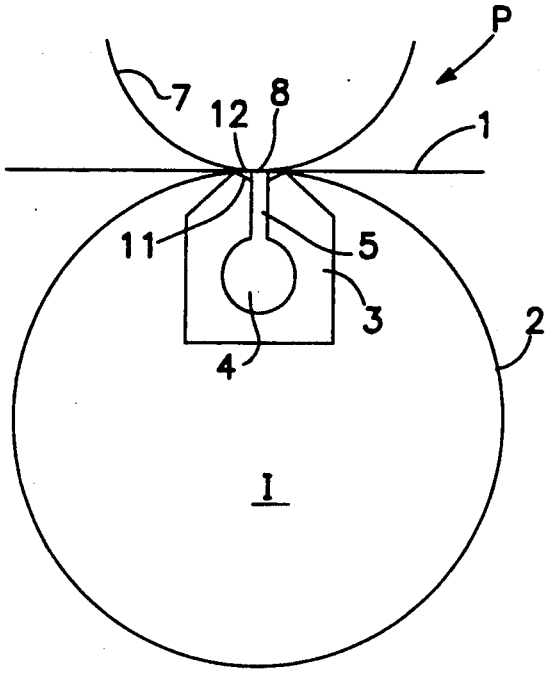

The invention relates to a method for applying liquid, pasty or plastic substances, in particular thermoplastics, through perforations f a cylinder, belt or the like to a substrate, in particular a textile fabric, and to a device for this purpose.

Corresponding methods and devices have been disclosed, for example, by German Offenlegungsschrift 3,826,395.5 and German Offenlegungsschrift 3,638,307.4 It is the object of the present invention to improve the method and device mentioned in these two documents.

In one way of achieving this object, the cylinder, the belt or the like encloses an interior space which is evacuated, preferably continuously, during the coating operation.

As a result of this evacuation, air is simultaneously drawn through the perforations. Particularly in the region of the coating location, vapors which are very harmful to the environment form during the coating operation with, for example, a hot thermoplastic. By means of the method according to the invention, these vapors are drawn through the perforations into the interior space of the cylinder or belt, and disposal thereof is then substantially easier. If these vapors precipitate in or on the vacuum pump or in a condenser, this vacuum pump should be associated with a precipitation vessel. If, in particular, the substrate to be coated is largely looped around the cylinder, before it is lifted off from the latter, the cylinder acts like a drying oven, i.e. the coating on the substrate is largely dried even before lifting off.

It is also provided that the weight of the coating is monitored periodically or continuously. This can be accomplished, on the one hand, by determining the height and areal extent of the coating. A corresponding method is feasible above all in the case of punctiform coating. As a result of punctiform coating, coating naps are formed which have a defined height and areal extent and which determine both the weight and the quality of the coating. By reference to the measurement of the height and areal extent, a conclusion can be drawn regarding the weight of the coating.

For determining the height and areal extent of the coating, stroboscopic lamps which detect the height and areal extent are, on the one hand, used according to the invention. The height and/or areal extent of the coating naps can be observed via a monitor. For this purpose, the monitor is provided with an appropriate index field, into which the coating naps must fit.

If the coating naps determined via the stroboscopic lamps drop out of the index field, the coating is either too thick or too thin.

The index fields are monitored by a computing unit and can be varied. By reference to the index field, the computing unit determines the weight of the coating, compares it with a reference value and accordingly varies the feed rate of the coating composition.

In addition, a weight measurement is provided in which, in a preferred embodiment example, the substrate runs over an appropriately mounted roll. For example, the roll can lean against appropriate supports which are deformable. The deformation is detected by appropriate strain gauges. However, the present invention is not intended to be restricted thereto.

In practice, it has been found that, in the coating of a substrate with a conventional thermoplastic, the coated substrate and a fabric, for example a textile fabric, applied thereto become relatively hard. Within the scope of the present invention an improvement in this respect is achieved when a foaming agent or gas is added to the coating substance. This foaming agent or gas has the effect that, for example, the density of coating naps decreases and that they more readily yield to a pressure. As a result, the complete coated fabric remains softer. As the foaming substance, for example, a powder can be chosen which foams up at a certain temperature. The foaming-up can here already occur when the substance is melted, but, in a preferred embodiment example, a powder should be chosen which foams up only in the coating head or when it is applied to the substrate.

According to the invention, a device is also provided for applying liquid, pasty or plastic substances in particular thermoplastics, through perforations to a substrate, in particular a textile fabric, wherein the perforations are formed in an endless coating belt, which is looped around a drive roller. Hitherto, the drive of the metal cylinder has been effected by means of an element arranged on the outside of the metal cylinder, for example a belt pulley. This involved difficulties when starting the device, inasmuch as the metal cylinder distorted on starting. This was the case above all when coating substance from the preceding coating operation still adhered to the metal cylinder.

The drive roller now provided according to the invention, which could of course also be used in a known metal cylinder, drives the cylinder or the belt uniformly over the entire length thereof, so that distortion no longer occurs.

In order to increase the friction between the drive roller and the coating belt, the drive roller should be provided with a rubber shell. However, it is also conceivable to design the drive roller as a spiked roller.

In the interior space of the coating belt, a blade should be arranged upstream of the drive roller, which blade removes coating material still adhering to the coating belt. In this way, the drive roller is protected.

By means of this arrangement of drive roller and coating belt, it is also possible to work without a coating head. If, for example, the drive roller is associated with a backing roll, the drive roller together with the backing roll can form a coating nip, in which a substrate is coated. The gusset between the drive roller and coating belt then forms a reception channel for the coating substance.

Figure 2:
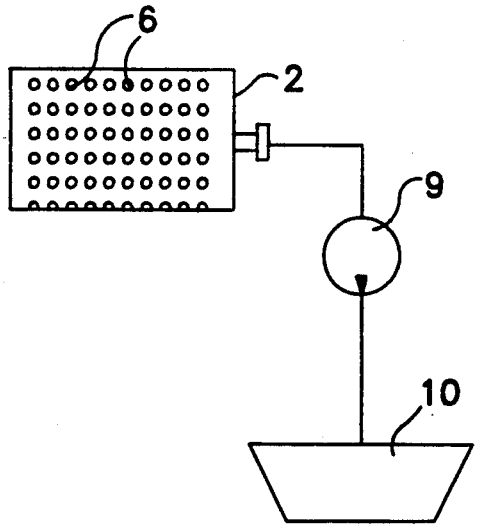
Figure 3:
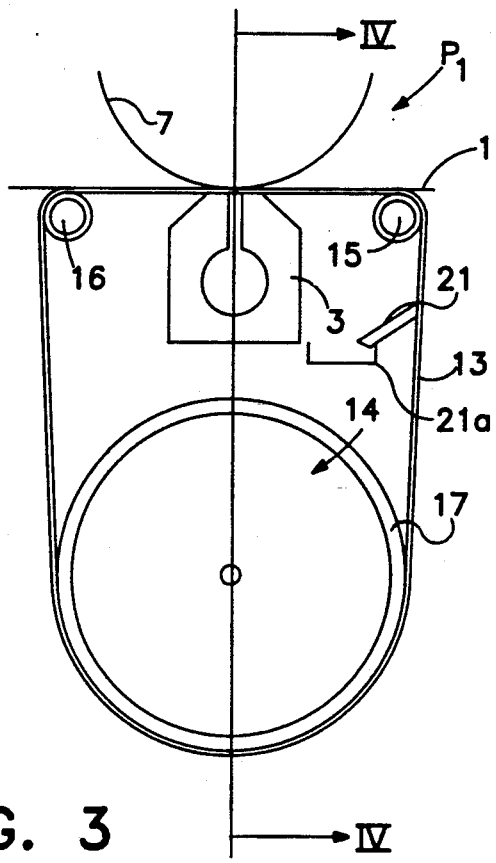
Figure 4:
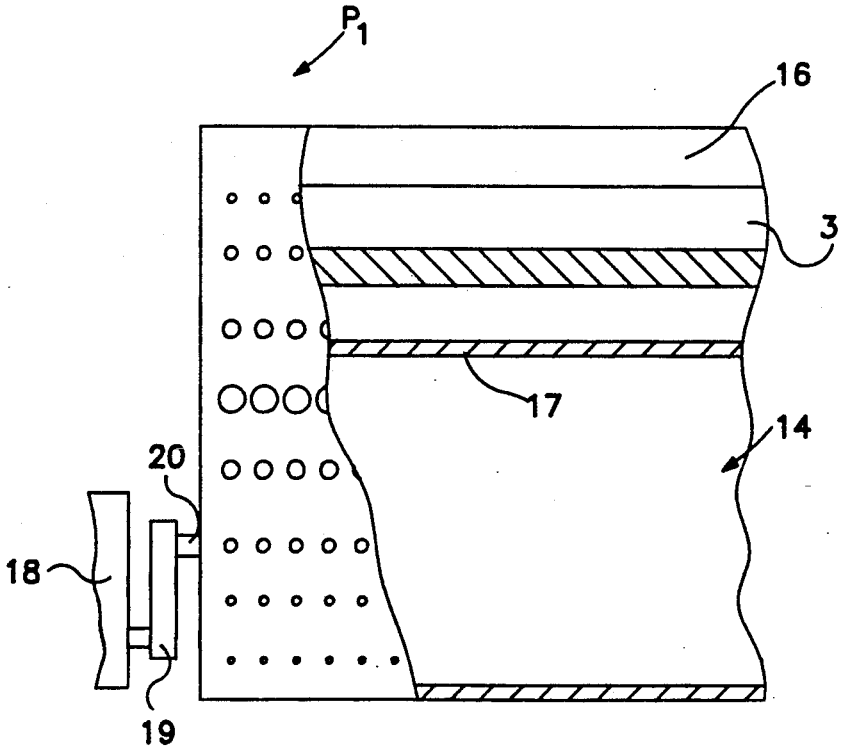
Figure 5:
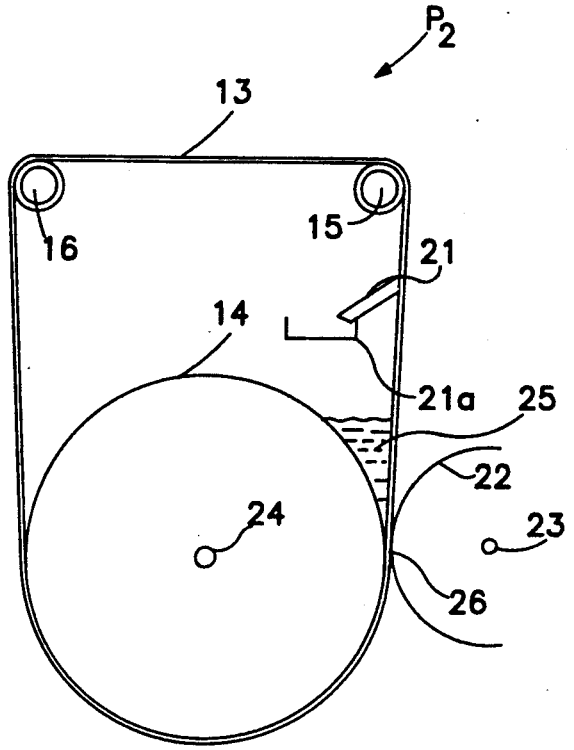
Figure 6:
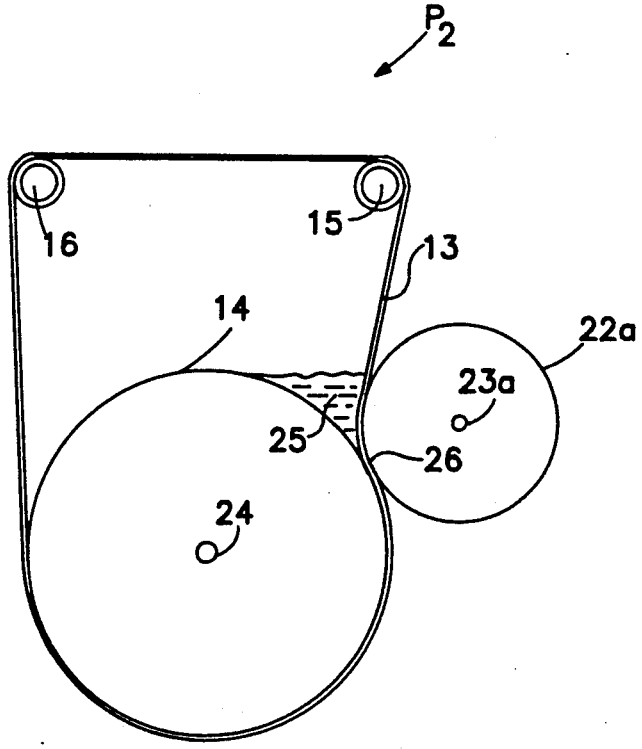
Figure 7:
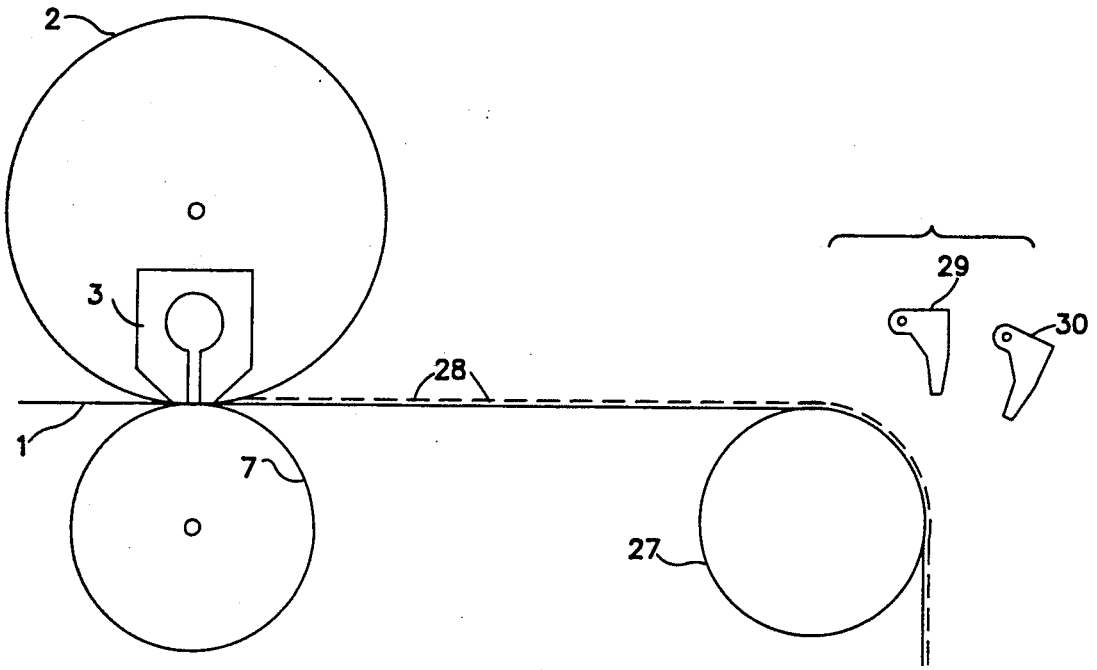
Figure 8:
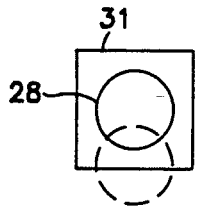
Figure 9:
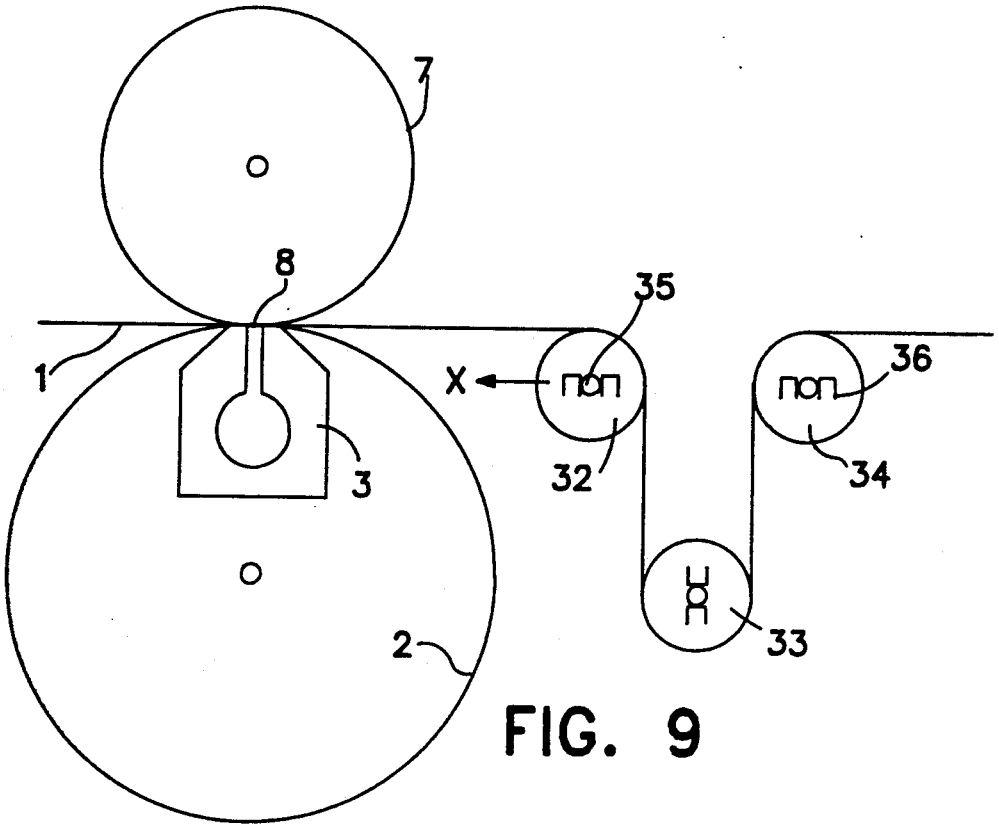
Figure 10:
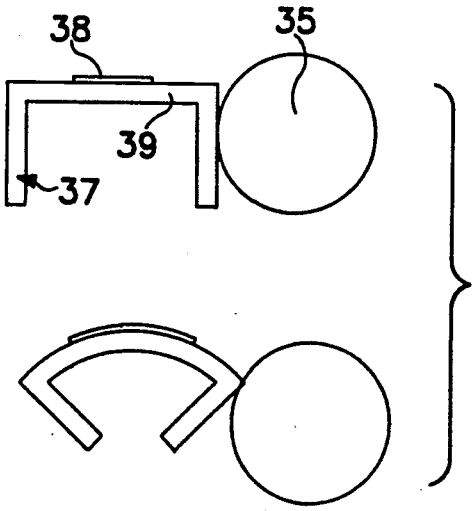

Further advantages, features and details of the invention can be seen from the following description of preferred embodiment examples and by reference to the drawing in which:

FIG. 1 shows a schematically represented cross-section through a device for coating a textile substrate, FIG. 2 shows a schematic representation, partially in the form of a block diagram, of parts of the device according to FIG. 1, FIG. 3 shows a cross-section through a further schematically represented embodiment example of a device for coating a substrate, FIG. 4 shows a detail of the device according to FIG. 3, partially broken open, FIG. 5 shows a schematically represented cross-section through a further embodiment example of a device for coating a textile substrate, FIG. 6 shows a schematically represented cross-section through a further embodiment example of a device for coating a textile substrate, FIG. 7 shows a schematically represented cross-section through a further embodiment example of a device for coating a textile substrate, FIG. 8 shows an illustration of a possibility of centering by elements from FIG. 7, FIG. 9 shows a schematically represented cross-section through a further embodiment example of a device for coating a textile substrate, and FIG. 10 shows a schematic representation of a support for axle journals and deflection rollers, over which the substrate to be coated runs after it has been coated.

According to FIG. 1, a device P according to the invention for coating a textile substrate 1 comprises a perforated metal cylinder 2, in the interior space of which a coating head 3 is located. Molten thermoplastic coating material passes through a chamber 4 and a nozzle slit 5 to the inner surface of the metal cylinder 2 and is forced out through the holes 6 shown in FIG. 2. This material thus impinges on the substrate 1.

The coating takes place in interaction with a backing roller 7, the substrate 1 running in a coating nip 8 between the backing roller 7 and the metal cylinder 2. Such a coating device is shown, for example, in German Offenlegungsschrift 3,638,307.4 and German Offenlegungsschrift 3,826,395.5.

According to the invention, a vacuum pump 9, with which a precipitation vessel 10 is associated, is connected to the metal cylinder 2 in the present embodiment example. The metal cylinder 2 is closed on all sides and merely has the said holes 6. Air is continuously removed by the vacuum pump 9 from the interior space I of the metal cylinder, which air has to be drawn into the latter again through the holes 6. Vapors, which are formed by the molten thermoplastic coating material during coating, however, are also extracted in this way.

The precipitation vessel 10 serves for intercepting and disposing of any condensate from these vapors, which might collect in or on the vacuum pump 9.

A further concept of the invention relates to sealing lips 11, which form a nozzle orifice 12 at the exit of the nozzle slit 5 and which bear against the interior of the metal cylinder 2. These should be made of a ceramic material and, in this case, preferably of a zirconium oxide. The sealing lips are then screwed as zirconium oxide strips to the steel of the coating head.

A further embodiment of a device Pl for coating a textile substrate 1 is shown in FIGS. 3 and 4. In these, a perforated coating belt 13 runs as an endless belt around a drive roller 14 and two deflection rolls 15 and 16. Preferably, the drive roller 14 is covered with a shell, for example a rubber shell 17, which increases the friction toward the coating belt 13. The drive roller 14 pulls the coating belt 13 through longitudinally, which makes it substantially easier for the coating belt 13 to be taken along.

An appropriate drive for the drive roller 14 is schematically shown in FIG. 4. This is a drive motor 18, whose rotary motion is transmitted via a step-up gear 19 to a drive shaft 20.

Moreover, the inner surface of the coating belt 13 is also associated, downstream of the coating head 3, with a blade 21 having a receiving container 21*a*, by means of which coating material is stripped off before the coating belt 13 loops around the drive roller 14. Appropriate discharges of the stripped material and a level indicator for the coating material 25 are not shown.

According to FIG. 5, in a further embodiment example of a device P2, the drive roller 14 interacts with a backing roll 22. The axle 23 of the backing roll 22 is here arranged approximately in a horizontal plane with the axle 24 of the drive roller 14. According to the embodiment example of FIG. 6, however, the axle 23*a* of the backing roll 22*a* is offset upwards, so that the coating belt 13 is indented.

Coating material 25 is filled into the space between the drive roller 14 and the coating belt 13 and is forced out in the nip 26 between the drive roller 14 and backing roll 22 through the perforations of the coating belt onto a substrate which is not shown in more detail.

Moreover, the drive roller 14 can also be a spiked roller or the like instead of a roller provided with a rubber shell 17.

FIGS. 7 to 9 relate above all to facilities for detecting the quantity of coating material present on the substrate. The quality of the coating depends above all on uniform coating. According to the invention, in a first embodiment example according to FIG. 7, the substrate runs after the coating nip 8 over a roll 27.

Reference numeral 28 illustrates enlarged coating naps, but this nap-like form is intended to be only an example.

According to the invention, the roll 27 is associated with stroboscopic lamps 29 and 30, which can be monitored by means of a monitor which is not shown in more detail. On this monitor, there are index fields 31, one of these index fields 31 being shown only by way of example in FIG. 8. A detection of the coating naps 28 with respect to height and areal extent is carried out by means of the index fields 31. This takes place in the following way:

At the start of the observation of the coating naps, a nap detected by the stroboscopic lamps 29 and 30 is as a rule located off-center, as is indicated by the dashed line. By means of appropriate readjustment devices, the stroboscopic lamps 29 and 30 are then adjusted in such a way that the coating nap 28 is located within the index field 31. The stroboscopic lamp 29 here effects the detection of the height of the coating nap above the substrate 1, whereas the stroboscopic lamp 30 monitors the areal extent. As soon as the height or areal extent of the coating nap 28 changes, this is detected by means of the index field 31 since, for example in the case of an increased areal extent, the coating nap 28 drops at least partially out of the index field 31. In this case, the respective operator can take the necessary measures for reducing the quantity of the coating material applied.

The arrangement according to FIG. 9 also serves a similar purpose. In this case, the substrate 1 runs, after the coating nip 8, over three deflection rolls 32, 33 and 34. These deflection rolls 32, 33 and 34 have axle journals 35 which are mounted in appropriate bearings 36. These bearings 36 here consist at least partially of flexible supports 37 of approximately U-shaped design. A strain gauge 38 is placed upon these supports 37. When, as shown in FIG. 10, the axle journal 35 bears against the support 37, the latter yields, and a joining arm 39, on which the strain gauge 38 rests, is bent. This entails an extension of this strain gauge 38, this extension being detected and monitored by an appropriate control unit which is not shown in more detail. If, for example, the weight of the coated substrate 1 increases, the deflection roll 32 attempts to yield in the direction x. As a result, the force exerted by the axle journal 35 on the support 37 increases. The latter bends, and this bending is transmitted to the strain gauge 38.

I claim:

1. A device for applying a coating material to a substrate through perforations, which comprises: first means closed on all sides thereof and defining an enclosed interior space, said first means having perforations therein; means for applying a coating material through said perforations; a backing means adjacent said first means, wherein said first means and said backing means form a coating nip therebetween; means for passing a substrate to be coated through said coating nip; and a vacuum pump operatively connected to said interior space to remove air and coating vapors from said interior space.

2. A device according to claim 1, including a precipitation vessel associated with the vacuum pump to remove condensate from the vacuum pump.

3. A device according to claim 1 wherein said backing means is a backing roller and said first means is a metal cylinder, wherein said metal cylinder interacts with said backing roller to form said coating nip therebetween.

4. A device according to claim 1 wherein said means for applying a coating material applies a liquid, pasty or plastic substance through said perforations.

5. A device according to claim 4 wherein said means for applying a coating material applies thermoplastic material through said perforations.

6. A device according to claim 1 including a coating head located within said first means, wherein molten thermoplastic material passes through said coating head and out the perforations onto the substrate.

7. A device according to claim 6 wherein said coating head includes a chamber connected to a nozzle slit which leads to the inner surface of the first means and forms an exit for the molten thermoplastic material at said perforations.

8. A device according to claim 7 including sealing lips which form a nozzle orifice at the exit of the nozzle slit and which bear against the inner surface of the first means.

9. A device according to claim 1 including means in the interior space operative to remove coating material from the first means.

10. A device according to claim 1 wherein said first means comprises an endless coating belt which is looped around a drive roller, wherein the perforations are formed in the endless belt.

11. A device according to claim 10 wherein the drive roller is operatively associated with a drive means.

12. A device according to claim 10 including blade means upstream of the drive roller in said interior space operative to remove coating material from the endless coating belt.

13. A device according to claim 10 wherein the endless belt also runs around at least two deflection rollers.

14. A device according to claim 10 wherein the drive roller is covered by a rubber shell.

15. A device according to claim 10 wherein said backing means is a backing roller and wherein said drive roller interacts with said backing roller to form said coating nip therebetween.

16. A device according to claim 15 wherein the axle of the backing roller is on an approximate horizontal plane with the axle of the drive roller.

17. A device according to claim 15 wherein the axle of the backing roller is opposite from the axle of the drive roller so that the coating belt is deflected as it passes through the coating nip.

18. A device according to claim 15 wherein a space is formed between the drive roller and the coating belt, and coating material is filled into said space and is forced out through the perforations in the coating belt onto the substrate passing through the coating nip.

* * * * *